United States Patent [19]

Fox et al.

[11] Patent Number: 4,593,259

[45] Date of Patent: Jun. 3, 1986

[54] WAVEGUIDE LOAD HAVING REFLECTING STRUCTURE FOR DIVERTING MICROWAVES INTO ABSORBING FLUID

[75] Inventors: Lowell J. Fox, San Carlos; John Dimeff, San Jose, both of Calif.

[73] Assignee: Varian Associates, Inc., Palo Alto, Calif.

[21] Appl. No.: 517,603

[22] Filed: Jul. 27, 1983

[51] Int. Cl.[4] ..... H01P 1/26

[52] U.S. Cl. ..... 333/22 F; 333/252

[58] Field of Search ..... 333/22 F, 22 R, 81 B, 333/81 R, 252, 248; 324/95, 92, 58 R, 58 A, 58 B, 58 C; 219/10.55 A, 10.55 F, 10.65

[56] References Cited

U.S. PATENT DOCUMENTS 3,289,109 11/1966 Nelson ..... 219/10.55 R
3,445,789 5/1969 Rossini ..... 333/252
3,633,131 1/1972 Nelson ..... 333/22 F
3,983,356 9/1976 Jurgensen ..... 219/10.55 A

*Primary Examiner*—James B. Mullins
*Assistant Examiner*—Benny Lee
*Attorney, Agent, or Firm*—Stanley Z. Cole; Richard B. Nelson; Peter J. Sgarbossa

[57] ABSTRACT

A calorimetric load for very high microwave power at very high frequencies is formed by a metallic, cylindrical chamber into which the wave-guide carrying the power opens. Inside the metallic cylinder is a coaxial dielectric cylinder, with a space between full of circulating wave-absorbing fluid such as water. The incoming wave may be in a higher-order mode. To make it disperse rapidly into the absorbing fluid, a conical reflector is located inside the dielectric cylinder to reflect the wave outward.

29 Claims, 4 Drawing Figures

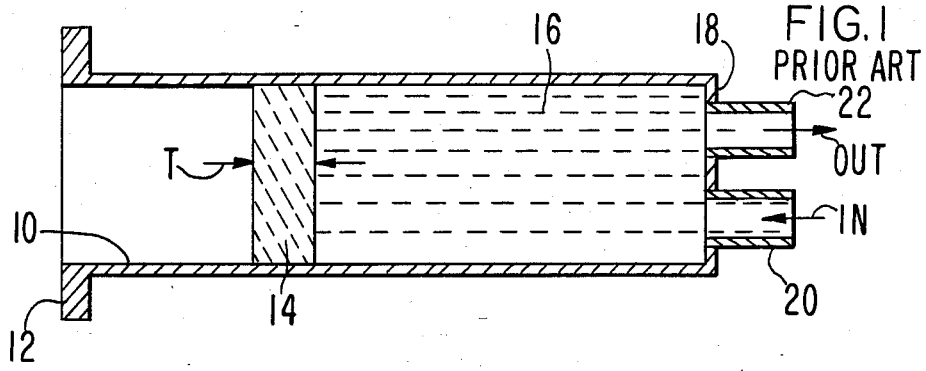
FIG. 1
PRIOR ART
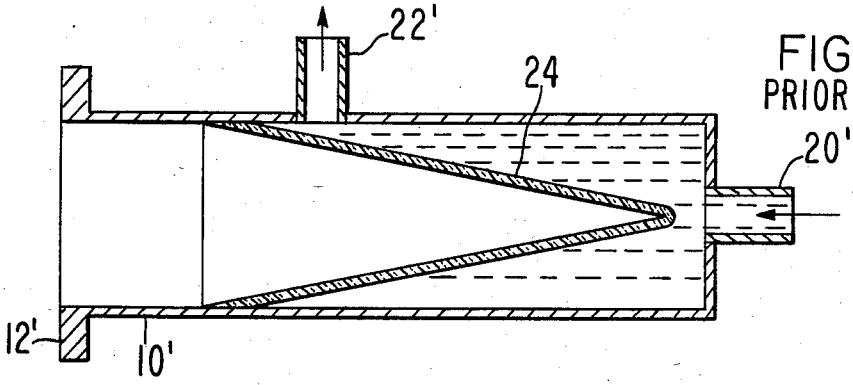
FIG. 2
PRIOR ART
FIG. 3
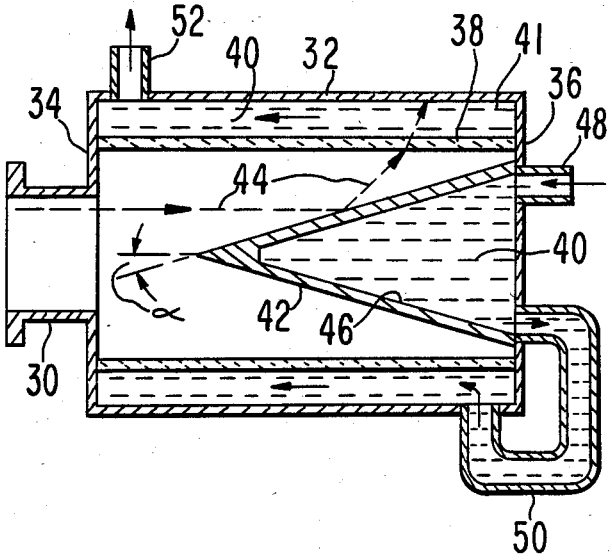
FIG. 4
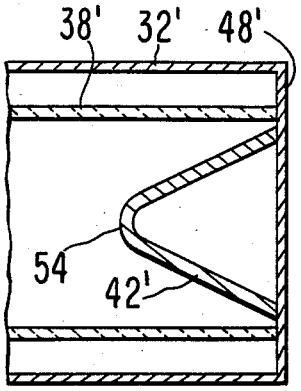

WAVEGUIDE LOAD HAVING REFLECTING STRUCTURE FOR DIVERTING MICROWAVES INTO ABSORBING FLUID

FIELD OF THE INVENTION

The invention pertains to high-power calorimetric loads for absorbing microwave energy in waveguides. Such loads are used to measure microwave power in testing components and systems. Also, in some circuit applications, a wave attenuator or a complete matched termination is needed.

PRIOR ART

Calorimetric loads have always been useful elements of radio-frequency (rf) power equipment. They convert rf wave energy to heat a circulating liquid (usually water). The power is measured as the product of the rate of flow of the liquid, its temperature rise, and its specific heat. At low frequencies, loads have absorbed the wave energy in resistive materials which in turn are cooled by the liquid. For very high power densities, the surface heat transfer from the resistive material to the liquid becomes a limitation.

At microwave frequencies the attenuation in pure water is high enough that the wave is generally absorbed directly by dielectric loss in the water. The load then consists of: an input waveguide, a wave-propagating chamber filled with circulating liquid, a low-loss dielectric window separating the liquid and the waveguide, and instruments for measuring the flow and the temperature rise of the liquid.

Many geometrical arrangements have been used, some of the problems being to distribute the power dissipation over a suitable volume of liquid and to provide a broadband match of the wave into the high-dielectric-constant liquid.

SUMMARY OF THE INVENTION

An object of the invention is to provide a waveguide calorimetric load for a wave with circular electric field.

A further object is to provide a load which will handle very high powers at very high frequencies.

A further object is to provide a compact, rugged load.

A further object is to provide a load which is well matched to its waveguide over a wide band of frequencies.

A further object is to provide a load which is easy to manufacture.

These objectives are realized by a load having a cylindrical window at the outside of the waveguide surrounded by a jacket of water. Wave energy propagating down the guide is deflected outward through the window by a conical, metallic reflecting member coaxial with the circular waveguide.

BRIEF DESCRIPTION OF THE DRAWINGS

FIG. 1 is an axial section of a prior-art load.

FIG. 2 is an axial section of another prior-art load having extended absorbing area.

FIG. 3 is an axial section of a load embodying the invention.

FIG. 4 is an axial section of a different embodiment of the invention.

DESCRIPTION OF THE PREFERRED EMBODIMENTS

In the prior-art load of FIG. 1, a waveguide 10 starting at a flange 12 for connection to a power source is sealed off by a dielectric window 14 behind which waveguide 10 is filled with water 16. The end of waveguide 10 is closed with a metallic baffle 18 through which water is circulated via input and output tubes 20,22. Instruments (not shown) are used to measure the temperature rise and flow rate of the water. As described in U.S. Pat. No. 3,445,789, issued May 20, 1969 to G. D. Rossini, the water chamber may have a baffle septum to direct the water flow over window 14. Waveguide 10 may be either circular or rectangular.

For a broadband waveguide match between the air-filled waveguide 10 and water 16, window 14 is preferably of a dielectric constant which is the geometric mean of those of air and water and is one-fourth of a guide wavelength in thickness. High-alumina ceramic has the preferred dielectric constant, about 9, and has excellent physical and dielectric properties.

Another prior-art waveguide load is shown in axial section in FIG. 2. Here waveguide 10' is cylindrical and the dielectric window 24 is in the shape of a hollow narrow cone. Water circulates through inlet 20' near the tip of cone 24', over the surface of window 24 and through outlet 22' near the base of cone 24. The load of FIG. 2 distributes the power over a larger area of ceramic-to-water interface, so this load is capable of handling more power than the simple load of FIG. 1. However, ceramic cone 24 is an expensive part and difficult to manufacture to the required tolerances. Grinding the inside of a narrow cone is particularly difficult.

Rapid advances are presently being made in generating very high powers at very high microwave frequencies. The foremost generator is a "gyrotron" crossed-field electron tube. The output of such a tube is typically in a circular waveguide transmitting a mode with transverse, circular electric field $TE_{on}$. The power and frequency levels are too high for most of the prior-art water loads. Loads have been proposed in which the power leaks out gradually from a long length of waveguide. However, the high-order modes involved tend to continue largely in a forward direction (to "beam") in the waveguide whose dimensions are large compared to a free-space wavelength. Thus, such loads are bulky and expensive.

FIG. 3 is an axial section of a load embodying the invention which solves most of the problems of prior-art loads. It is compact, easily fabricated, and can be designed for any suitable density of power dissipation. The wave enters through a waveguide 30 which may be of rectangular or preferably circular cross-section. The absorbing body of the load is in a closed, metallic, cylindrical shell 32 which is typically, but not necessarily, somewhat larger than input waveguide 30. Cylinder 32 is closed at both ends by metallic end-plates 34,36. Inside cylinder 32 and coaxial with it is the dielectric window 38, which is a hollow cylinder, preferably of ceramic, sealed at its ends to end-plates 34,36. The absorbing liquid 40 is circulated between shell 32 and window 38 in a cylindrical passage 41 which is of radial thickness to substantially absorb the wave in one passage outward and reflected back inward.

A high-order circular-electric-field mode would ordinarily beam through the length of window 38 without sufficient spreading to divert most of its energy into fluid 40. To provide the desired spreading over the desired length (to keep the power density within desired limits), a conductive cone 42, as of copper, is disposed coaxially within window 38, its base sealed to end plate 36 and its tip pointing toward the entering wave. The angle $\alpha$ of cone 42 is chosen to provide the desired axial length of the power dissipation area. The entering wave is reflected by the outer surface of cone 42 outward through window 38 into absorbing fluid 40. Particularly for a $TE_{on}$ mode whose electric field is parallel to the surface of cone 42, the wave reflection is quite specular. Arrows 44 indicate direction of wave energy flow. To remove heat generated by rf current flow in reflector 42, fluid 40 is circulated through its hollow interior 46 via inlet and outlet pipes 48,50. This fluid flow may be in series with the flow through the main absorbing passage 41, leaving through exit pipe 52. Alternatively, the two flow paths may be in parallel. With cooling by parallel flow paths, reflector 42 may be made of a high-resistance conductor such as austenitic stainless steel to help absorb some of the power.

Reflector 42 need not be of a true conical shape. Indeed, if the pattern of the mode to be absorbed is known, the shape may be calculated to provide the most uniform distribution of dissipation, hence, the shortest length of the load. FIG. 4 illustrates schematically a shape which might be used for the $TE_{01}$ mode. There is no electric field on the axis, hence, no power flow. The nose 54 of reflector 42' which reflects the low, paraxial field may be blunt as shown to reflect this power in a short distance. The blunt shape is advantageous for making reflector 42' by hydroforming.

The advantages of the inventive load include: short axial length due to control of the energy distribution, ruggedness, ease of manufacture, particularly of the cylindrical dielectric window which is easy to make of precision-ground ceramic, and a good match to the incoming wave.

The above embodiments are intended to be exemplary and not limiting. Many other embodiments will be obvious to those skilled in the art. The invention is to be limited only by the following claims and their legal equivalents.

What is claimed is:

1. A microwave load for use with a waveguide comprising:

a first hollow elongated chamber generally of conductive material, said first hollow elongated chamber having a first end and a second end, said first hollow elongated chamber having an opening at said first end, said opening being located in a first plane;

means for sealing said opening to an end of a waveguide;

a second hollow elongated chamber of dielectric material, said second hollow elongated chamber having a first end and a second end, said second hollow elongated chamber being generally centered in said first hollow elongated chamber and entirely within said first hollow elongated chamber, said first end of said first hollow elongated chamber being sealed to said first end of said second hollow elongated chamber, said second end of said first hollow elongated chamber being sealed to said second end of said second hollow elongated chamber, the hollow interior of said second hollow elongated chamber communicating with said opening;

means for filling a microwave absorbing fluid between said second hollow elongated chamber and said first hollow elongated chamber;

and a microwave reflective body having a continuous reflective surface inside said second hollow elongated chamber, said reflective surface protruding toward said first end of said second hollow elongated chamber, and said body having cross-sections in second and third planes parallel to said first plane containing said opening, said second and third planes being selected at random from planes intersecting said microwave reflective body with said second plane being nearer said first plane than said third plane is near said first plane, said cross-section in said second plane being smaller than said cross-section in said third plane;

whereby an electromagnetic wave entering said second hollow elongated chamber through said opening is at least partially reflected by said microwave reflective body outwardly through said second hollow elongated chamber of dielectric material into the microwave absorbing fluid.

2. The microwave load of claim 1 wherein said microwave reflective body is a metal-surfaced cone.

3. The microwave load of claim 1 wherein said microwave reflective body is joined to said second end of said first hollow elongated chamber and to said second end of said second hollow elongated chamber.

4. The microwave load of claim 1 including a passage inside said microwave reflective body for circulation of a coolant.

5. The microwave load of claim 4 wherein the coolant is the same as the microwave absorbing fluid.

6. The microwave load of claim 5 wherein a surface of said microwave reflective body closest to said first end of said first hollow chamber is of material with high electrical resistance.

7. The microwave load of claim 1 wherein said means for sealing said opening includes means for sealing said opening to a waveguide of circular cross-section.

8. The microwave load of claim 1 wherein said second hollow elongated chamber is a hollow elongated cylinder.

9. The microwave load of claim 8 wherein said reflective body is a metal-surfaced cone.

10. The microwave load of claim 1, in which said microwave reflective body is hollow.

11. The microwave load of claim 10, in which said means for filling the microwave absorbing fluid includes means for facilitating the circulation of the fluid within said hollow microwave reflective body as a coolant.

12. The microwave load of claim 10, in which said hollow microwave reflective body and said second hollow elongated chamber define a liquid-impermeable barrier.

13. A microwave load for accepting microwave power, comprising:

an outer container having an opening means for communicating with an ouptut of a hollow waveguide;

dielectric window means including a hollow dielectric chamber in the form of a figure of revolution about an axis entirely within said outer container;

means for filling a microwave absorbing fluid between an outer surface of said hollow dielectric chamber and said outer container;

and means within said hollow dielectric chamber for reflecting received microwave power through said window means into the microwave absorbing fluid.

14. The microwave load of claim 13, in which said hollow dielectric chamber and said outer container means are fluid-impermeable.

15. The microwave load of claim 13, in which said means for reflecting received microwave power presents a convex reflecting surface to arriving microwave power.

16. The microwave load of claim 13, in which said convex surface defines a cone-like shape.

17. The microwave load of claim 15, in which said convex surface is defined by a figure of revolution about the axis.

18. The microwave load of claim 17, in which said convex surface and said outer container bound a hollow shape.

19. The microwave load of claim 18, in which said convex surface and said outer container are fluid-impermeable.

20. A microwave load for use with a waveguide comprising:

a hollow chamber generally of conductive material having a first end and a second end;

a hollow dielectric cylinder within said hollow chamber, said hollow dielectric cylinder being defined by a figure of revolution about a longitudinal axis, said hollow dielectric cylinder being sealed to said ends of said hollow chamber, and having an opening means in said first end of said hollow chamber adapted and shaped for communication with a waveguide;

means for filling a microwave absorbing fluid between said dielectric cylinder and said chamber;

and a conductive microwave reflective body inside said dielectric cylinder defined by a figure of revolution about the axis, said microwave reflective body being tapered smaller toward said opening;

whereby an electromagnetic wave entering said hollow dielectric cylinder through said opening means is at least partially reflected by said microwave reflective body outwardly through said hollow dielectric cylinder into said fluid.

21. The microwave load of claim 20, in which said figure of revolution about said axis and said second end of said hollow chamber bound a cone shaped body.

22. The microwave load of claim 21, in which said cone shaped body has a rounded apex.

23. A microwave load for accepting for dissipation microwave power transmitted by a hollow waveguide, comprising:

a hollow container, said hollow container being defined by a figure of revolution about an axis, said hollow container having an outer generally conductive wall and two outer end walls, a first outer end wall adapted for connection to and communication with a hollow waveguide, a second outer end wall being closed;

means for introducing a microwave absorbing fluid through said outer walls of said container;

a first inner wall protruding axially inwardly from said second outer end wall of said hollow container, said first inner wall being conductive and reflective of microwave power, at least a portion of said first inner wall being at an obtuse angle to said axis;

a second inner wall comprising a hollow dielectric cylinder coaxially positioned about said conductive axially-protruding first inner wall and joined to said hollow container, the microwave absorbing fluid being contained between said hollow container and said second inner wall, an interior of said hollow cylinder communicating with a hollow waveguide to define a window between microwave power entering from a waveguide and the microwave absorbing fluid;

whereby said entering microwave power is reflected by said axially protruding conductive inner wall outwardly through said window into the microwave absorbing fluid.

24. A microwave load as in claim 23 which further includes means for circulating the microwave absorbing fluid between said inner walls and outer wall of said container.

25. A microwave load as in claim 23 in which said first axially protruding inner wall tapers smaller in the direction it protrudes.

26. A microwave load as in claim 23 in which said first axially protruding inner wall defines a cone-like shape pointing toward said waveguide.

27. A microwave load as in claim 25 in which said first axially protruding inner wall is rounded off at its furthest protrusion.

28. A microwave load as in claim 27 in which said second inner wall is fluid-impermeable.

29. A microwave load as in claim 27 in which said first inner wall is fluid-impermeable.

* * * * *